US005602714A

United States Patent [19]

Shimizu et al.

[11] Patent Number: 5,602,714

[45] Date of Patent: Feb. 11, 1997

[54] IGNITION COIL FOR INTERNAL COMBUSTION ENGINE

[75] Inventors: Takeshi Shimizu; Takafumi Narishige, both of Himeji, Japan

[73] Assignee: Mitsubishi Denki Kabushiki Kaisha, Tokyo, Japan

[21] Appl. No.: 451,161

[22] Filed: May 26, 1995

[30] Foreign Application Priority Data

Jul. 19, 1994 [JP] Japan ..... 6-167072

[51] Int. Cl.[6] ..... F02P 3/02

[52] U.S. Cl. ..... 361/623; 123/647; 361/253

[58] Field of Search ..... 336/185, 96; 439/620; 123/633, 634, 655, 644, 647; 29/748, 747, 605; 361/600, 601, 622, 623, 728, 807–811, 253, 263

[56] References Cited

U.S. PATENT DOCUMENTS

| | | | |
|---|---|---|---|
| 4,248,201 | 2/1981 | Tsutsui et al. | 123/647 |
| 5,111,790 | 5/1992 | Grandy | 123/425 |
| 5,170,767 | 12/1992 | Wada et al. | 123/633 |
| 5,172,302 | 12/1992 | Taruya et al. | 361/386 |
| 5,419,300 | 5/1995 | Maruyama et al. | 123/634 |
| 5,429,103 | 7/1995 | Rich | 361/256 |
| 5,485,825 | 1/1996 | Shimizu | 123/634 |

FOREIGN PATENT DOCUMENTS 587034 4/1993 Japan .

*Primary Examiner*—Gerald P. Tolin

*Attorney, Agent, or Firm*—Sughrue, Mion, Zinn, Macpeak & Seas

[57] ABSTRACT

The purpose of the present invention is to obtain a low-cost and easy-to-produce ignition coil for an internal combustion engine.

A lead wire 13*a* of an electronic part 13 is connected to a terminal 12*a* and a terminal 7*a* of an intermediate conductor 12 by means of caulking or press fitting. Since the end cut face of the lead wire 13*a* of the electronic part 13 is sharp, a wall material 71 and a cover 81 as crack spread preventing materials are arranged so as to encircle that end cut face. Further, an opening portion 92 is closed by the intermediate conductor 12, and high voltage is output via a spring 11 directly contacted to the intermediate conductor 12.

The number of components may thus be reduced, and cracks generating in an insulating resin may be prevented from spreading.

7 Claims, 6 Drawing Sheets

IGNITION COIL FOR INTERNAL COMBUSTION ENGINE

BACKGROUND OF THE INVENTION

Field of the Invention

The present invention relates to an ignition coil for an internal combustion engine. More specifically, the present invention relates to an easy-to-produce and low-cost ignition coil for an internal combustion engine.

FIG. 6 shows a cross sectional view of an ignition coil for an internal combustion engine, while FIG. 7 shows its plan view. In the figures, a core 1 is a core of closed magnetic circuit type which goes through a coil body as described later. A primary bobbin 2 is arranged so as to encircle a part of said core 1. On the outskirts of the primary bobbin 2, a primary coil 3 as a conductive wire is formed so as to wind around the core 1. Low voltage terminals 4*a* and 4*b* are arranged on a case 9. One end of said primary coil 3 is connected to said terminal 4*a*, while the other end of said primary coil 3 is connected to said terminal 4*b*.

On the outskirts of said primary coil 3, a secondary bobbin 5 is arranged so as to encircle said core 1 and said primary bobbin 2. On the outskirts of said secondary bobbin 5, a secondary coil 6 is formed so as to wind around said core 1 and said primary bobbin 2, and a conductive wire of, for example about 100 times the number of turns of said primary coil 3, is wound around. Arranged on said secondary bobbin 5 are terminals 7*a* and 7*b*, to which both the ends of said secondary coil 6 are respectively connected. Said primary coil 3 is also connected to said terminal 7*a*. Said primary bobbin 2 and said secondary bobbin 5 are contained in said case 9, and a resin material 8 is mounted on said secondary bobbin.

An opening end 9*a* to take out high voltage is arranged at said case 9, and a high voltage terminal 10 made of a conductor is mounted within this opening end 9. One end of said high voltage terminal 10 is thread-cut, while the other end is cylindrical, and a spring 11 is contained in its inside.

As shown in FIG. 8 and FIG. 9, an intermediate conductor 12 as a supporting material is mounted on said resin material 8, and one end of an electronic circuit device 13 is electrically connected to a terminal 12*a* arranged at said intermediate conductor 12, while the other end of an electronic part 13 is electrically connected to a terminal 7*b* arranged at said secondary bobbin 5. A lead 13*a* of said electronic circuit device 13 is wound around or hooked to said terminal 12*a* and terminal 7*b*, and then electrically connected by means of soldering. This electronic circuit device 13 has a role to prevent the voltage generating at the start of electricity flow into the primary side from outputting. Respective components contained within said case 9 are fixed and insulated by an insulating resin 14 as an injection resin such as epoxy resin or so.

The ignition coil engine described above operates as shown below. Namely, when electricity is supplied from said external device not shown in the figure via said terminals 4*a* and 4*b* to said primary coil 3, said primary coil 3 generates magnetic flux, which runs through said core 1 and crosses said secondary coil 6. After a lapse of a certain amount of time, if the electricity to said primary coil 3 is shut down, magnetic flux that has crossed said secondary coil 6 decreases rapidly. Then, according to the principle of electromagnetic induction, this flux change generates high voltage in proportion with the number of turns of said primary coil 3 and said secondary coil 6. Next, high voltage generated is output via said electronic part 13, said intermediate conductor 12, said high voltage terminal 10, and said spring 11.

In the ignition coil for an internal combustion engine as described above, there have been problems, for instance, in that it is difficult to hook the lead wire of the electronic circuit device on a connecting point or wind it around by means of soldering, and in that soldering near the coil causes solder spatter to the scatter to coil, resulting in possible short-circuiting within the coil. Also in order to seal the opening portion for high voltage, the case wall is pinched from the outside and the inside, therefore, a high pressure terminal is needed in addition to an intermediate conductor, thus increasing the number of parts. Furthermore, there is also the problem that the sharp cut face of the lead wire end portion of the electronic part in contact with an insulating resin causes cracks in the insulating resin.

SUMMARY OF THE INVENTION

It is an object of the present invention to solve the above problems for example by providing an easy-to-produce, low-cost and highly reliable ignition coil for internal combustion engines by reducing the number of its components.

According to one aspect of the present invention, there is provided an ignition coil for an internal combustion engines comprising: a core; a primary coil and a secondary coil to which magnetic flux is changed through the core; a primary bobbin and a secondary bobbin to align the primary coil and the secondary coil; an intermediate conductor fixed to the primary bobbin and the secondary bobbin; a terminal fixed onto the primary bobbin or the secondary bobbin and connected to the coil of the primary coil or the secondary coil; an electronic part connected electrically to the intermediate conductor and the terminal; a case to contain the respective components; and an insulating resin filled into the case, wherein the lead wire of the electronic part is fixed to the intermediate conductor and the terminal by means of caulking or press fitting.

Other objects and advantages of the present invention will become apparent from the detailed description to follow taken in conjunction with the appended claims.

BRIEF DESCRIPTION OF THE DRAWINGS

These and other objects and many of the attendant advantages of this invention will be readily appreciated as the same becomes better understood by reference to the following detailed description when considered in connection with the accompanying drawings in which.

DESCRIPTION OF THE PREFERRED EMBODIMENTS

The invention is illustrated in more details by reference to the following examples and preferred embodiments.

EMBODIMENT 1

Figure 1:
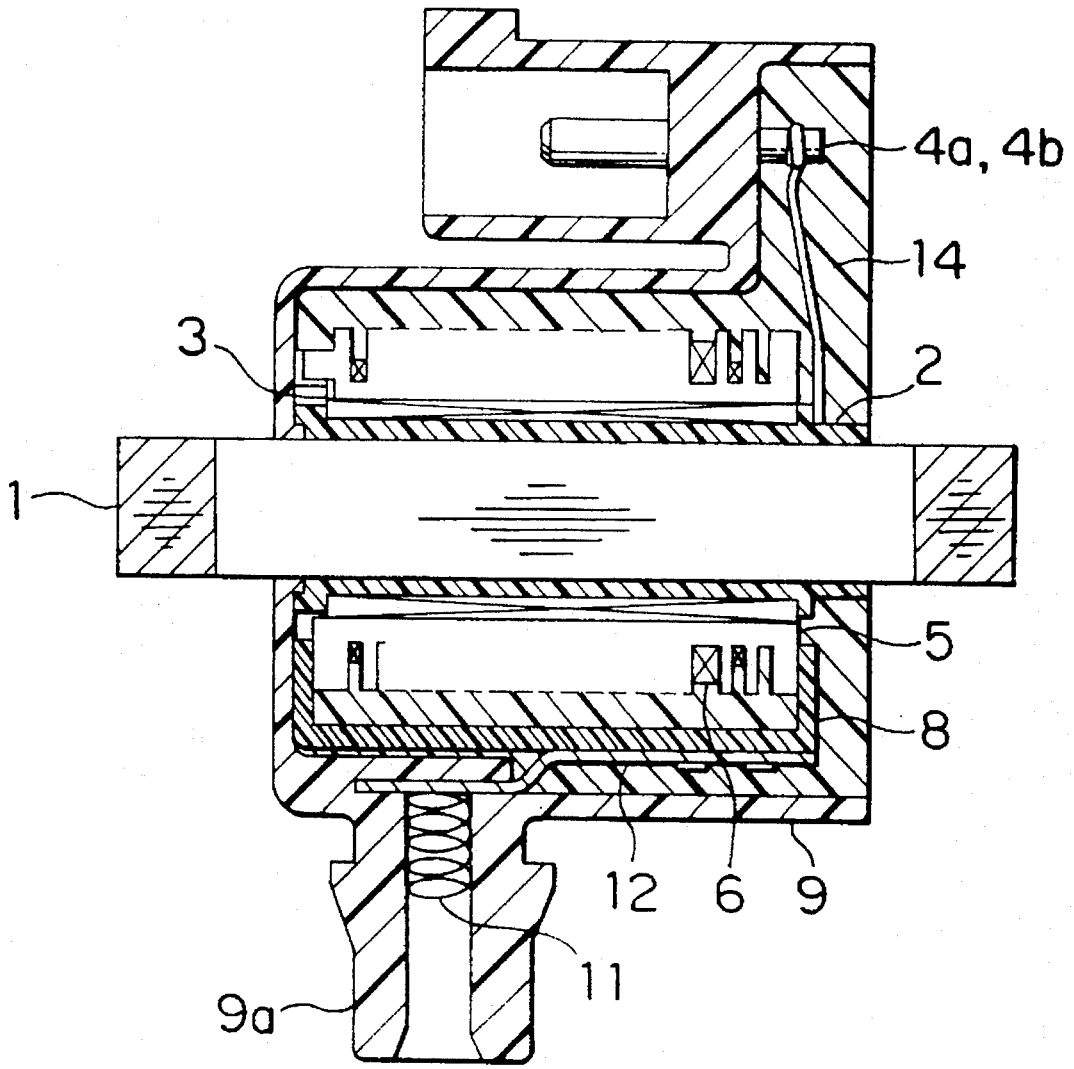
FIG. 1 shows a cross sectional view of an ignition coil for internal combustion engine in accordance with a preferred embodiment of the present invention.
Figure 2:
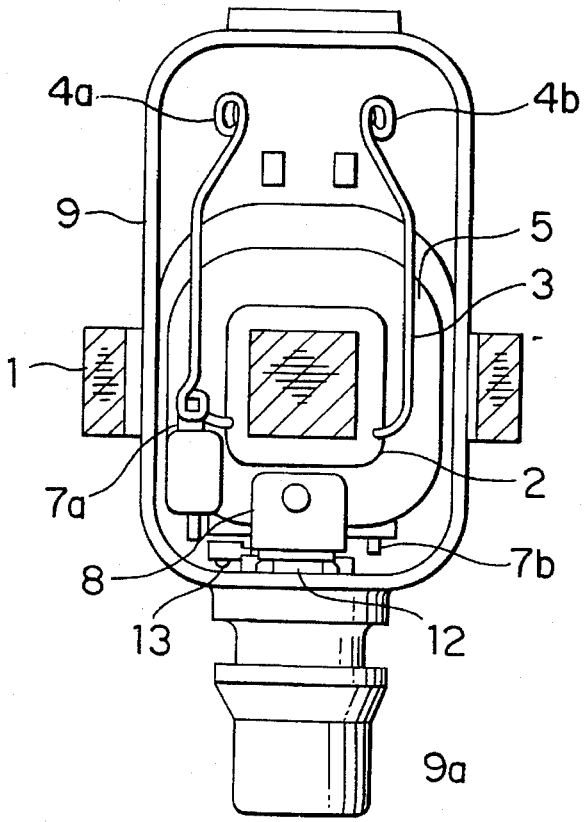
FIG. 2 shows a plan view of an ignition coil for an internal combustion engine in accordance with a preferred embodiment of the present invention.
Figure 3:
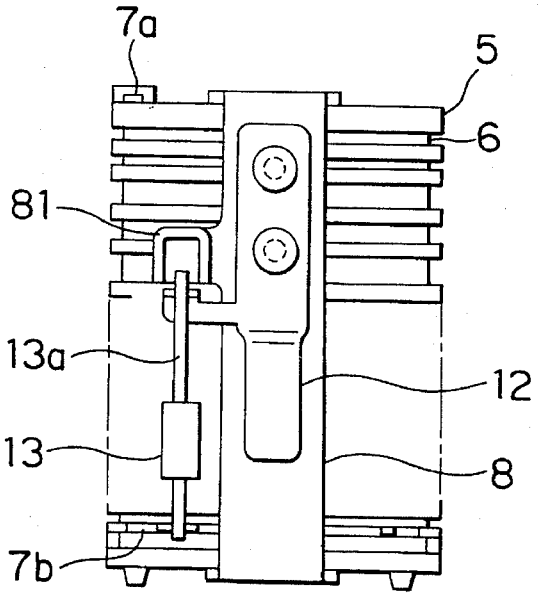
FIG. 3 shows a main side view of an ignition coil for an internal combustion engine in accordance with a preferred embodiment of the present invention.
Figure 4:
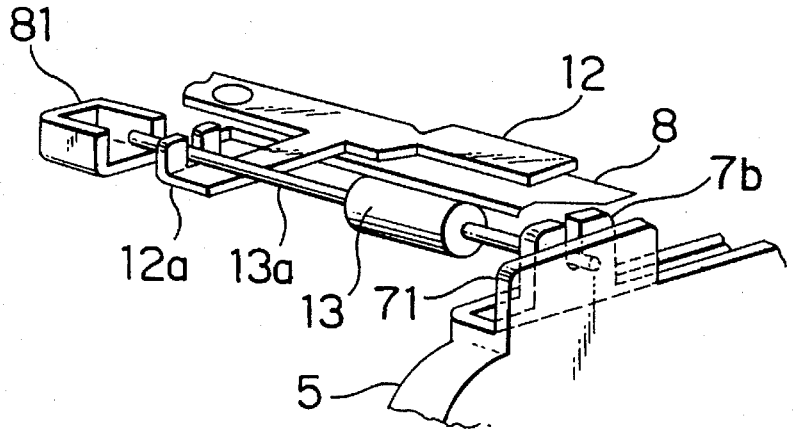
FIG. 4 is a schematic oblique view showing an intermediate conductor and an electronic part and the like of an ignition coil for internal combustion engine in accordance with a preferred embodiment of the present invention.

FIG. 1 shows a cross sectional view of an ignition coil for an internal combustion engine in accordance with a preferred embodiment of the present invention, while FIG. 2 shows a plan view of that. FIG. 3 shows a main side view of an ignition coil for an internal combustion engine in accordance with a preferred embodiment of the present invention, while FIG. 4 is a schematic oblique view showing an intermediate conductor and electronic part and the like of an ignition coil for an internal combustion engine in accordance with a preferred embodiment of the present invention. By the way, identical numbers in these figures represent the same or equivalent parts.

In these figures, a lead wire 13*a* of an electronic circuit device 13 is connected to a terminal 12*a* and a terminal 7*a* of an intermediate conductor 12 by means of caulking or press fitting. When the lead wire 13*a* is caulked to the terminals 12*a* and 7*b*, the clearance arranged at the center between the terminals 12*a* and 7*b* is made slightly wider than the thickness of that lead wire 13*a*, and then the lead wire 13*a* is loaded into the clearance and terminals 12*a* and 7*b* are pressed and fitted into the clearance so as to close the clearance. When the lead wire 13*a* is pressed into the terminals 12*a* and 7*b*, the clearance arranged at the center between the terminals 12*a* and 7*b* is made slightly narrower than the thickness of that lead wire 13*a*, and then the lead wire 13*a* is pushed into the clearance to be fixed there. Accordingly, the mounting operation of the electronic circuit device 13 is simplified, and an automatic operation is available.

Since the end cut face of the lead wire 13*a* of the electronic circuit device 13 is sharp, a wall material 71 and a cover 81 are arranged so as to encircle that end cut face and prevent cracks from spreading. The wall material 71 is formed integrally with a secondary bobbin 5 where the terminal 7*b* is mounted, while the cover 81 is formed by a part of a resin material 8. The wall material 71 and cover 81 prevent possible cracks generating in an insulating material 14 that is filled from the end face of the lead wire 13*a* into the inside of a case 9 from spreading to a wide range. While the figures show the wall material 71 or the cover 81 as crack spread preventing material, any form of crack spread preventing material may be employed, so far as it prevents cracks generating in the insulating material 14 from spreading. Also it is preferable that a crack spread preventing material is arranged at both the ends of the lead wire 13*a*, but it may also be arranged at one end.

Figure 5:
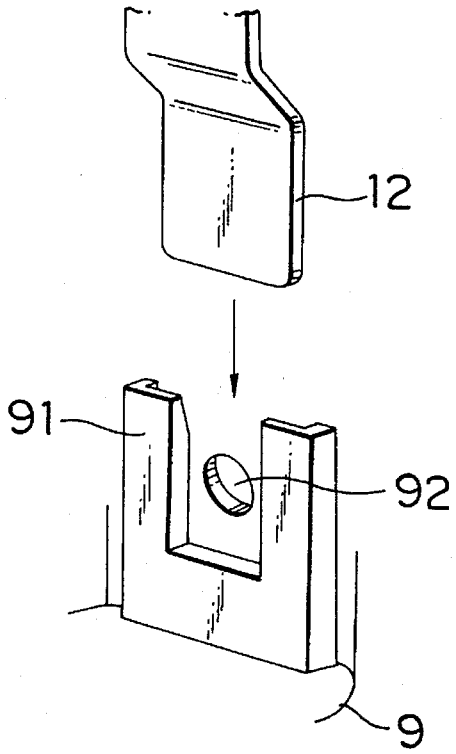
FIG. 5 is a schematic oblique view showing the mounting status of an intermediate conductor to a case in accordance with a preferred embodiment of the present invention.
Figure 6:
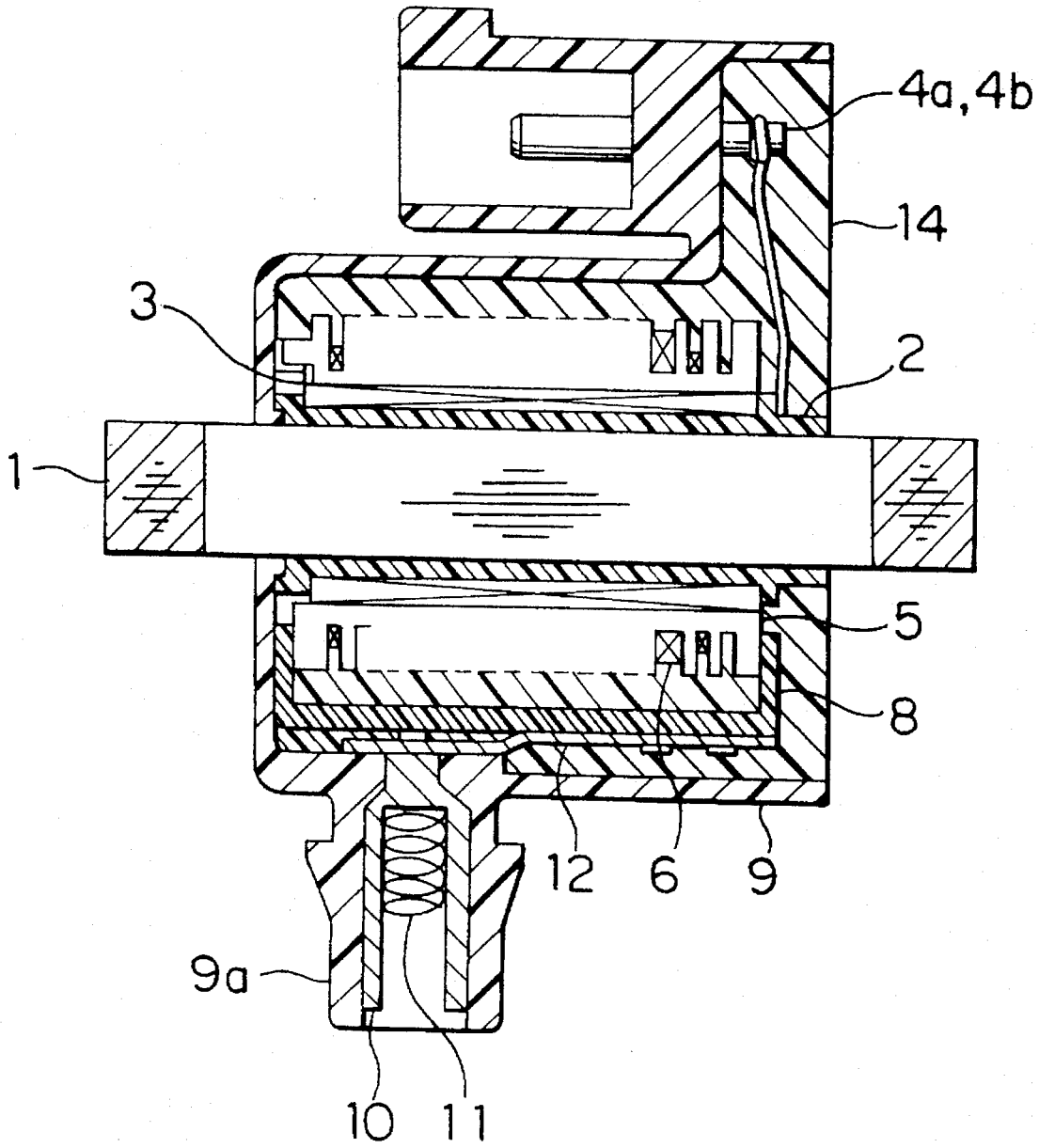
FIG. 6 is a cross sectional view showing an ignition coil for an internal combustion engine.
Figure 7:
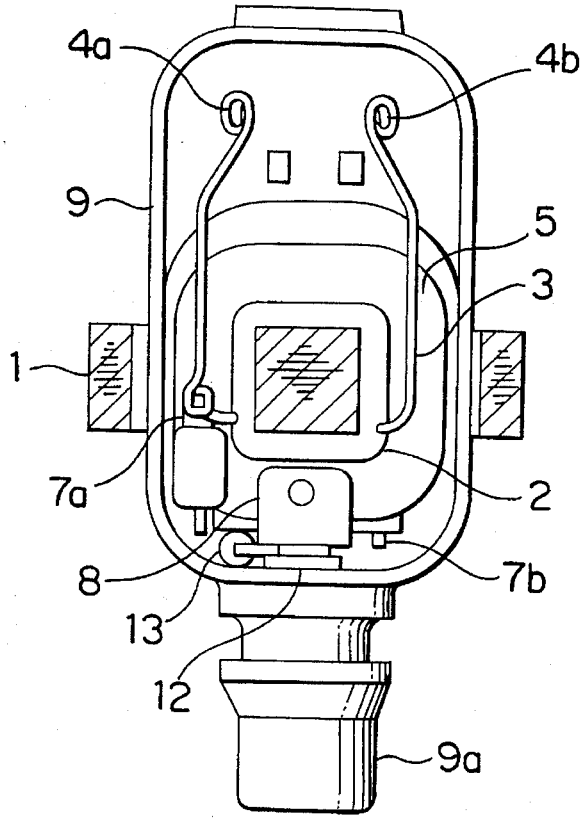
FIG. 7 is a plan view showing an ignition coil for an internal combustion engine.
Figure 8:
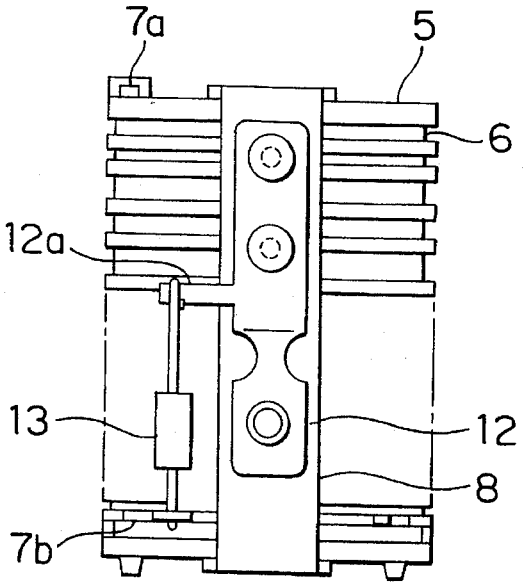
FIG. 8 is a main side view showing an ignition coil for an internal combustion engine.
Figure 9:
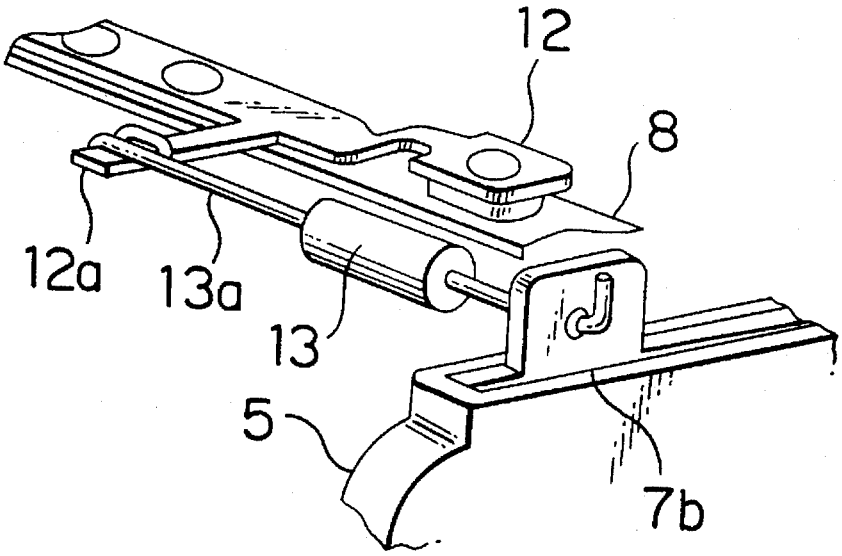
FIG. 9 is a schematic oblique view showing an intermediate conductor and an electronic part and the like of an ignition coil for an internal combustion engine.

FIG. 5 is a schematic oblique view showing the mounting status of an intermediate conductor to a case in accordance with a preferred embodiment of the present invention. The intermediate conductor 12, whose output end portion is made into a plate shape, e.g., flattened, etc. is inserted and fixed into a press fitting portion 91 arranged on the inside wall of the case 9 as shown in FIG. 5 and FIG. 1. This fixing method enables to seal the opening portion 92 arranged on the case 9 by the inserted intermediate conductor 12, and to prevent the insulating resin 14 from leaking out. The spring 11 which is to be inserted into the opening portion 92, is designed so as to be conductive with the intermediate conductor 12. Consequently, the opening portion 92 is closed by the intermediate conductor 12, and high voltage is supplied to the external via the spring 11 directly contacted to the intermediate conductor 12. Thus, there is no need to arrange the conventional high pressure terminal 10, and the number of parts and production costs are reduced.

EMBODIMENT 2

In the above Embodiment 1, the connection of the electronic part for the purpose of preventing reverse voltage output, however, the connection of other, for example, a resistance for ignition noise reduction may be employed in the embodiment under the present invention as well as the above, and in this case too, the same effect is obtained.

The invention may be embodied in other specific forms without departing from the spirit or essential characteristics thereof. The present embodiments are therefore to be considered in all respects as illustrative, and not restrictive to the scope of the invention being indicated by the appended claims rather than by the foregoing description and all changes which come within the meaning and range of equivalency of the claims are therefore intended to be embraced therein.

What is claimed:

1. An ignition coil for an internal combustion engine comprising:

a) a core;

b) a primary coil and a secondary coil arranged to create magnetic flux through said core;

c) a primary bobbin and a secondary bobbin mounting said coils to align said primary coil and said secondary coil;

d) an intermediate conductor fixed to said primary bobbin and said secondary bobbin;

e) a terminal fixed onto said primary bobbin or said secondary bobbin and connected to the coil of said primary coil or the secondary coil;

f) an electronic circuit element having a first lead connected electrically to said intermediate conductor and a second lead connected electrically to said terminal;

g) a case containing said respective components a–f; and h) an insulating resin filled into said case, wherein the leads of said electronic circuit element is fixed to said intermediate conductor and said terminal by means of caulking or press fitting.

2. An ignition coil for an internal combustion engine according to claim 1, wherein a crack spread preventing material is arranged near the end of at least one of said first and second leads of said electronic circuit element to prevent said end of said one lead from spreading cracks in said insulating resin.

3. An ignition coil for an internal combustion engine according to claim 1, wherein an opening end is arranged on the case for outputting high voltage, and said opening end is sealed by said intermediate conductor from the inside of said case, and high voltage is supplied from said intermediate conductor as a high voltage terminal.

4. An ignition coil for an internal combustion engine according to claim 2, wherein an opening end is arranged on the case for outputting high voltage, and said opening end is sealed by said intermediate conductor from the inside of said case, and high voltage is output from said intermediate conductor as a high voltage terminal.

5. An ignition coil for an internal combustion engine according to claim 2, wherein said crack spread preventing material forms a wall, said wall being integral with said secondary bobbin in the vicinity of said end of said second lead and said insulating resin.

6. An ignition coil for an internal combustion engine according to claim 5, wherein said wall encircles said end of said second lead.

7. An ignition coil for an internal combustion engine according to claim 2, wherein said crack spread preventing material forms a cover shaped to receive the portion of said intermediate conductor which is connected to said first lead and said end of said first lead to prevent said end of said first lead from spreading cracks in said insulating resin.

* * * * *